US007306345B2

(12) United States Patent
Golle et al.

(10) Patent No.: US 7,306,345 B2
(45) Date of Patent: Dec. 11, 2007

(54) HIGH VISIBILITY SAFETY SIGN

(75) Inventors: Aaron Golle, Eden Prairie, MN (US); John Golle, Eden Prairie, MN (US)

(73) Assignee: Safe Lites, LLC, Eden Prairie, MN (US)

( * ) Notice: Subject to any disclaimer, the term of this patent is extended or adjusted under 35 U.S.C. 154(b) by 194 days.

(21) Appl. No.: 10/645,873

(22) Filed: Aug. 21, 2003

(65) Prior Publication Data

US 2004/0114349 A1 Jun. 17, 2004

Related U.S. Application Data

(60) Provisional application No. 60/429,671, filed on Nov. 27, 2002.

(51) Int. Cl.
*F21V 9/16* (2006.01)

(52) U.S. Cl. ..... 362/84; 362/540; 40/544

(58) Field of Classification Search ..... 362/34, 362/84, 540, 485, 501, 505, 506; 40/544, 40/588–593; 37/219, 235; 340/468–473
See application file for complete search history.

(56) References Cited

U.S. PATENT DOCUMENTS

| | | | | |
|---|---|---|---|---|
| 2,721,808 | A * | 10/1955 | Shepard et al. | 428/209 |
| 2,758,401 | A | 8/1956 | Wilson | |
| 2,844,388 | A * | 7/1958 | Rheeling | 280/851 |
| 2,983,914 | A * | 5/1961 | Fuller | 340/815.77 |
| 4,087,124 | A | 5/1978 | Wiley, Jr. | |
| 4,297,675 | A | 10/1981 | Rubottom et al. | |
| 4,494,326 | A * | 1/1985 | Kanamori | 40/593 |
| 4,603,065 | A | 7/1986 | Mori et al. | |
| 4,645,970 | A * | 2/1987 | Murphy | 313/509 |
| 4,895,110 | A | 1/1990 | LoCascio | |
| 4,927,177 | A | 5/1990 | Price | |
| 5,005,306 | A * | 4/1991 | Kinstler | 362/486 |
| 5,025,351 | A | 6/1991 | Martin | |
| 5,337,224 | A * | 8/1994 | Field et al. | 362/84 |
| 5,339,550 | A * | 8/1994 | Hoffman | 40/544 |
| 5,367,806 | A * | 11/1994 | Hoffman | 40/544 |
| 5,426,414 | A * | 6/1995 | Flatin et al. | 340/472 |
| 5,434,013 | A * | 7/1995 | Fernandez | 428/690 |
| 5,437,113 | A | 8/1995 | Jones | |
| 5,444,930 | A | 8/1995 | Loew | |
| 5,479,325 | A * | 12/1995 | Chien | 362/105 |
| 5,485,355 | A * | 1/1996 | Voskoboinik et al. | 362/84 |
| 5,497,304 | A * | 3/1996 | Caine | 362/485 |
| 5,518,561 | A * | 5/1996 | Rosa | 156/71 |
| 5,533,289 | A | 7/1996 | Hoffman | |
| 5,566,384 | A * | 10/1996 | Chien | 362/486 |

(Continued)

FOREIGN PATENT DOCUMENTS

| | | |
|---|---|---|
| DE | 10108713 | 9/2002 |

(Continued)

*Primary Examiner*—Sandra O'Shea
*Assistant Examiner*—Jason Moon Han
(74) *Attorney, Agent, or Firm*—Schwegman, Lundberg, & Woessner, P.A.

(57) ABSTRACT

A safety sign and methods are shown with advantages such as being more visible in poor conditions such as snow, dust, fog, low light, etc. Safety signs as shown can be seen from farther away than conventional signs. Safety signs as shown eliminate problems associated with point source lighting.

7 Claims, 5 Drawing Sheets

U.S. PATENT DOCUMENTS 5,621,991 A * 4/1997 Gustafson ..... 40/544
5,666,269 A 9/1997 Romero et al.
5,692,327 A 12/1997 Wynne et al.
5,709,455 A * 1/1998 Danekas et al. ..... 362/485
5,775,016 A * 7/1998 Chien ..... 40/544
5,779,346 A * 7/1998 Burke ..... 362/84
5,909,960 A * 6/1999 Jager et al. ..... 37/235
6,112,437 A 9/2000 Lovitt
6,164,804 A * 12/2000 Self ..... 362/485
6,195,925 B1 * 3/2001 Werner ..... 40/591
6,203,391 B1 * 3/2001 Murasko ..... 445/24
6,309,764 B1 10/2001 Burrows
6,371,633 B1 4/2002 Davis
6,409,367 B1 6/2002 Pratt
6,446,879 B1 9/2002 Kime
6,551,726 B1 4/2003 Burrows
6,604,834 B2 8/2003 Kalana
6,637,906 B2 * 10/2003 Knoerzer et al. ..... 362/84
6,751,898 B2 * 6/2004 Heropoulos et al. ..... 40/544
6,778,077 B1 8/2004 DeGraaf
6,840,098 B2 1/2005 Halliday
6,874,904 B2 4/2005 Hsu
7,128,449 B2 10/2006 Golle et al.
2001/0024370 A1 * 9/2001 Macher et al. ..... 362/492
2002/0181226 A1 12/2002 Saminski et al.
2003/0231485 A1 12/2003 Chien
2004/0128882 A1 * 7/2004 Glass ..... 40/544
2007/0002553 A1 1/2007 Goelle et al.

FOREIGN PATENT DOCUMENTS

GB 2358913 A * 8/2001
WO WO-9857097 A1 12/1998

* cited by examiner

Stay Back Stay Alive Sign

Lamp Baseline Assumptions:

- Lamp Size: 8.5″ x 72″
- Construction: Hybrid
- Lit Color: Yellow has a yellow on/off color
- Interconnection: Crimp with Wires
- ITO Substrate Thickness: 0.007″ (0.178mm)
- Nominal Lamp Thickness: 0.015″ (0.38mm)
- Part Label: On packaging
- Adhesive: None
- Insulator: 0.0015″ tape (a thicker laminate may be required for durability)
- Overprint: TBD

Power Supply Specs

| | |
|---|---|
| Driver | 2-Amp or 5-Amp driver (120Vrm/60Hz input » 140Vrms/600Hz output) |

*Fig. 10*

HIGH VISIBILITY SAFETY SIGN

RELATED APPLICATION (S)

This application claims benefit under 35 U.S.C. § 119 (e) of U.S. Provisional Application No. 60/429,671 filed Nov. 27, 2002, which is incorporated herein by reference.

TECHNICAL FIELD

This invention relates to safety equipment. Specifically, this invention relates to safety signs that exhibit high visibility.

BACKGROUND

There are many hazardous activities that can be made safer by warning people using safety signs. Specific examples include, but are not limited to, signs on snowplows to warn traffic as they approach from behind, slow moving vehicle signs such as are commonly attached to farm vehicles, oversized load signs on the back of highway transportation vehicles, road construction signs, etc.

Necessarily, for a safety sign to be effective, it must be seen by the person to be warned. In certain road safety situations, as listed above, an approaching vehicle's headlights can illuminate the safety signs. However, headlights are not always adequate to provide the necessary warning. Further, there are other applications of safety signs not involving vehicles with headlights, where the person to be warned requires increased visibility of safety signs in poor visibility conditions, from large distances, at night, etc.

Existing configurations of signs that are self lit, such as by incandescent bulbs, have a number of disadvantages. They require large amounts of power to operate. They produce large amounts of unwanted heat. In an application involving snow, in particular, heat can be detrimental by melting snow to water, which may cause electrical failure and/or icing problems. When existing configurations fail, they fail catastrophically. For example, if a rock from a road hits an incandescent bulb, the bulb breaks and fails completely. Also, when an incandescent bulb bums out, it goes from on to off without any warning, or in between condition.

Existing lit configurations also suffer from negative effects of point source lighting. Point sources, such as incandescent bulbs or light emitting diodes (LEDs) provide an intense source of light from a single point. Point sources can cause night blindness after a viewer looks away from the point source light. Also, point source lights appear to flicker and move around when viewed. This is due to their single source beams being distorted by elements such as dust particles, snow flakes, or other elements of the atmosphere between the point source and the viewer. Point source lights also have a limited viewable distance, or penetration through snow, fog, etc. due to similar scattering and distortion of the single source beam.

What is needed is an improved safety sign with high visibility in difficult conditions such as in snow, fog, dust, at night, etc. What is also needed is an improved safety sign without the disadvantages of point source lighting.

SUMMARY

The above mentioned concerns such as power, heat, durability, and point source lighting are addressed by the present invention and will be understood by reading and studying the following specification.

A safety sign is shown. The safety sign includes a pattern selected to convey a visual safety message, and an EL lighting surface that contrasts the pattern, allowing the pattern to be seen from a distance. The safety sign also includes a power source coupled to the EL lighting surface.

A method is also shown. The method includes forming a safety sign by selecting a pattern to convey a visual safety message and attaching the pattern to an EL lighting surface. The method further includes attaching the safety sign to one or more vehicles and driving the vehicles in a formation on a road wherein the safety signs are visible to provide guidance for the vehicles.

A method is also shown that includes forming a safety sign by selecting a pattern to convey a visual safety message and attaching the pattern to an EL lighting surface. The method also includes attaching the safety sign to a transportation vehicle carrying an oversized load and driving the vehicle on a road wherein the safety sign is visible to provide warning of the oversized load.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

FIG. 10 shows specifications for an embodiment of a safety sign according to an embodiment of the invention.

DETAILED DESCRIPTION

Figure 1:
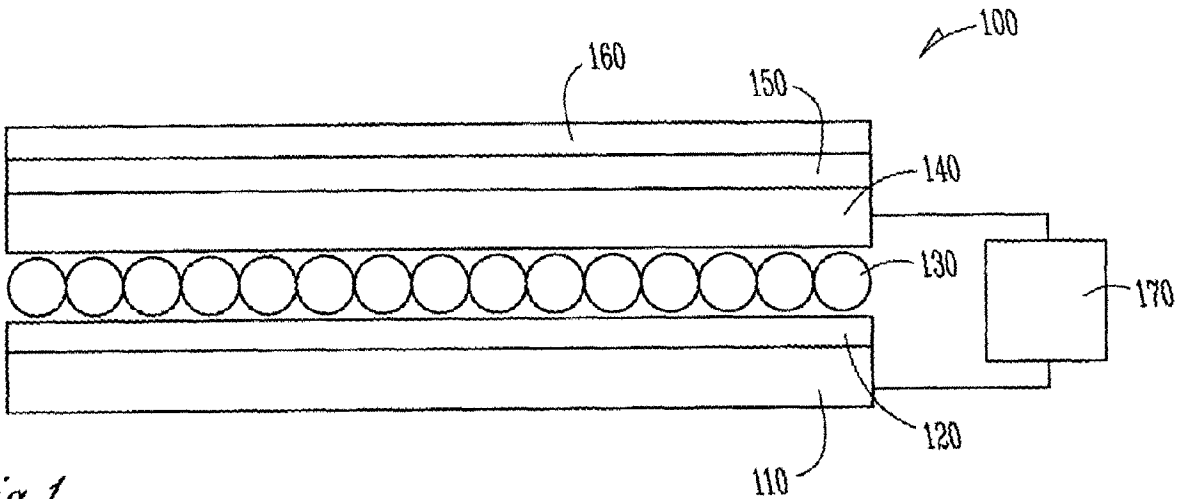
FIG. 1 shows a cross section diagram of a safety sign according to an embodiment of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, electrical changes, etc. may be made without departing from the scope of the present invention.

FIG. 1 shows a safety sign 100 utilizing electroluminescent (EL) technology. A conducting base 110 is shown with a dielectric layer 120 coupled to the conducting base 110. The base is for some embodiments rigid and for other embodiments flexible. This feature enables the sign to be positioned on rigid or flexible surfaces. A number of encapsulated phosphor portions 130 are shown coupled to the dielectric layer 120. In one embodiment, the number of encapsulated phosphor portions 130 are microencapsulated. A second conducting portion 140 is shown coupled over the number of encapsulated phosphor portions 130. In one embodiment, the second conducting portion 140 includes a transparent conductor material. In one embodiment, an encapsulating layer 150 is included over the second conducting portion 140. In one embodiment, the encapsulating layer 150 is included to provide moisture or weather resistance. A pattern layer 160 is further shown coupled over the encapsulating layer 150. In one embodiment, the pattern layer 160 defines a message or symbol that indicates safety or caution.

One of ordinary skill in the art, having the benefit of the present specification will recognize that alternative designs of an EL lighting device are possible. FIG. 1 is intended to illustrate one possible embodiment of an EL lighting configuration in a safety sign. One good example of EL lighting can be obtained from the Durel corporation of Chandler, Ariz.

Figure 2:
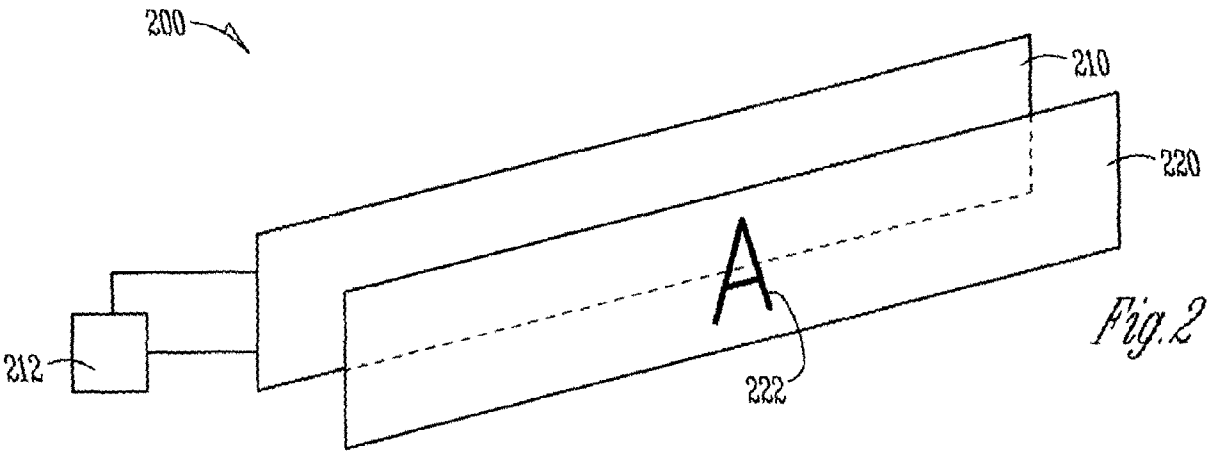
FIG. 2 shows an isometric view of a safety sign according to an embodiment of the invention.

FIG. 2 shows an embodiment of a safety sign 200. The safety sign 200 includes an EL lighting surface 210, and a power source 212 coupled to the EL lighting surface 210. In one embodiment, the power source 212 includes an AC power source. In one embodiment, the power source 212 includes a DC power source coupled to an AC converter. In one embodiment, the power source is supplied by a power hook up on a vehicle. A layer 220 is also included, with a pattern 222 located on the layer 220. In FIG. 2, the layer 220 includes a transparent layer. The pattern 222 in FIG. 2 is substantially opaque. Embodiments of patterns 222 include, but are not limited to, text, numbers, symbols, shapes, etc. The safety sign 200 operates by transmitting light from the EL lighting surface 210 through portions of the layer 220 that are not obscured by the pattern 222. As used herein, the term "vehicle" refers to two-wheeled, three-wheeled and four-wheeled automobiles, trucks, semi's, fire engines, trains, rail cars, snowplows, bicycles, police cars, buses, ambulances, and any other vehicle having safety needs.

Figure 3:
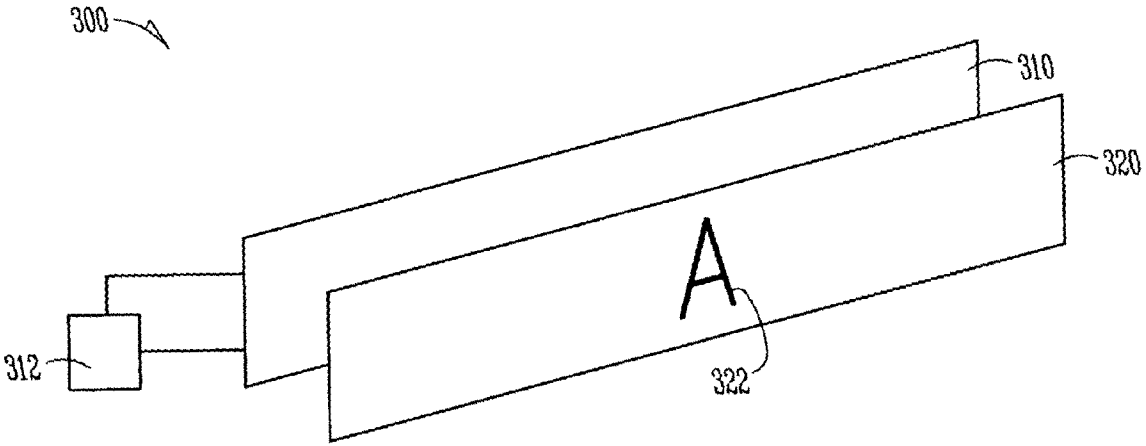
FIG. 3 shows an isometric view of a safety sign according to an embodiment of the invention.

FIG. 3 shows an embodiment of a safety sign 300. The safety sign 300 includes an EL lighting surface 310, and a power source 312 coupled to the EL lighting surface 210. Power source 312 includes, but is not limited to embodiments of power sources described above. A layer 320 is also included, with a pattern 322 located on the layer 320. In FIG. 3, the layer 320 includes a substantially opaque layer. The pattern 322 in FIG. 3 is substantially transparent. In one embodiment, the pattern 322 is cut out from the layer 320. Pattern 322 includes, but is not limited to embodiments of patterns described above. The safety sign 300 operates by transmitting light from the EL lighting surface 310 through the substantially transparent pattern 322.

Figure 4:
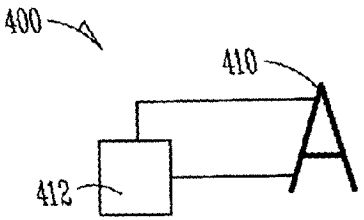
FIG. 4 shows a front view of a safety sign according to an embodiment of the invention.

FIG. 4 shows an embodiment of a safety sign 400. The safety sign 400 includes an EL lighting surface 410, and a power source 412 coupled to the EL lighting surface 410. Power source 412 includes, but is not limited to embodiments of power sources described above. In one embodiment, the EL lighting surface 410 is shaped into a pattern. The pattern includes, but is not limited to embodiments of patterns described above. The safety sign 400 operates by transmitting light from the EL lighting surface 410 directly in a pattern that conveys a message of safety. A text pattern may, for example, convey a warning. A triangle or other geometric shape may indicate a slow moving vehicle, etc.

Figure 5:
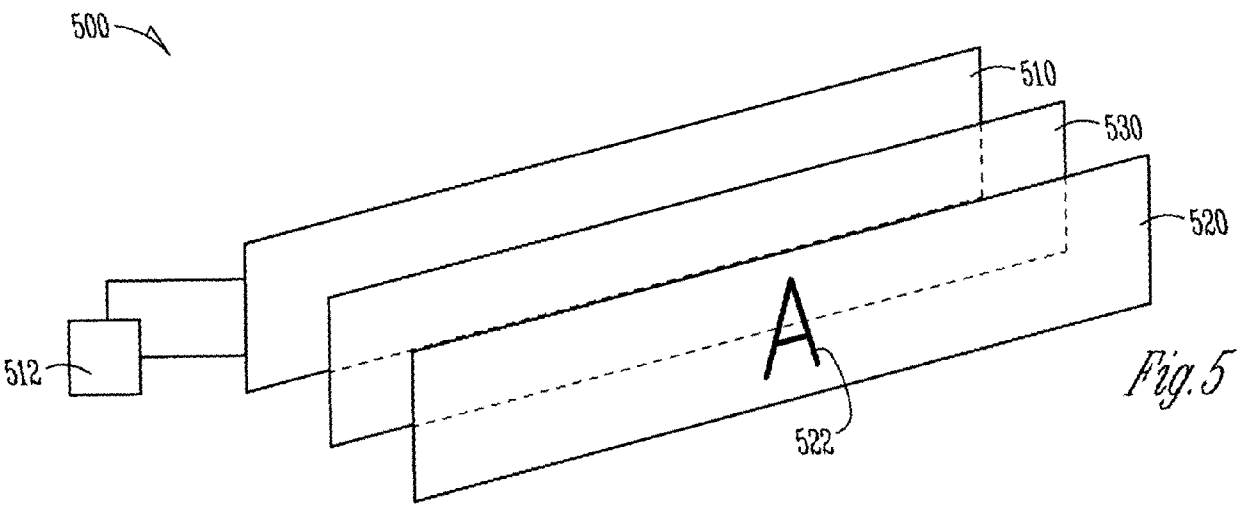
FIG. 5 shows an isometric view of a safety sign according to an embodiment of the invention.

FIG. 5 shows an embodiment of a safety sign 500. The safety sign 500 includes an EL lighting surface 510, and a power source 512 coupled to the EL lighting surface 510. Power source 512 includes, but is not limited to embodiments of power sources described above. A layer 520 is also included, with a pattern 522 located on the layer 520. In FIG. 5, the layer 520 includes a transparent layer. The pattern 522 in FIG. 2 is substantially opaque. Alternatively, the layer 520 in FIG. 5 may include a substantially opaque layer with a pattern 522 that is substantially transparent. A layer 530 is further included in the safety sign 500. The layer 530 includes properties that alter a color of the EL lighting surface 510.

Selected embodiments of safety signs as described in this document include colored EL material. Both an illuminated color and a non-illuminated color may be selected. Possible colors include yellow, white, blue-green, etc. A color can be chosen in the non-illuminated condition that is suited for daytime, while a different color can be chosen for the illuminated condition to optimize both day and night. The addition in safety sign 500 of a layer 530 further broadens color options. In one embodiment, the layer 530 is tinted to alter the color of the EL lighting surface. In one embodiment, an EL lighting surface is included that is white in a non-illuminated condition, and blue-green in an illuminated condition. In one embodiment, a yellow tinted layer 530 is further included. This provides a yellow appearance in the day, with a light green appearance at night. In one embodiment, the light green complies with government regulations for color. In another embodiment, an EL lighting surface is included that is yellow in a non-illuminated condition, and yellow in an illuminated condition. In one embodiment, a yellow tinted layer 530 is further included. This provides a yellow appearance in the day, and a yellow appearance at night.

In one embodiment, the pattern 522 is cut out from the layer 520. Pattern 522 includes, but is not limited to embodiments of patterns described above. The safety sign 500 operates by transmitting light from the EL lighting surface 510 through the layer 530 and through substantially transparent portions of the layer 520.

Figure 6:
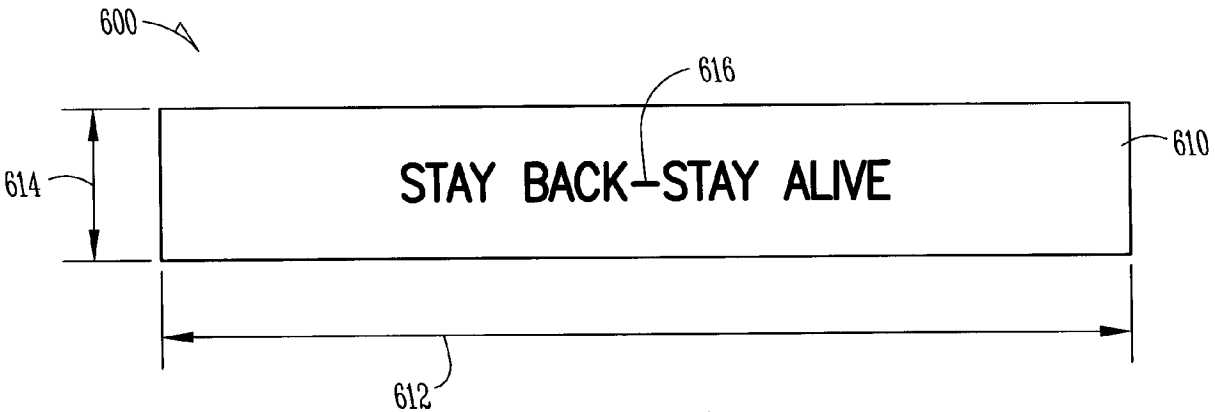
FIG. 6 shows a front view of a safety sign according to an embodiment of the invention.

FIG. 6 shows one embodiment of a safety sign 600. The safety sign 600 includes an EL lighting surface 610. In one embodiment the shape of the safety sign 600 is dictated by a government standard. In FIG. 6, the EL lighting surface 610 of the safety sign 600 is substantially rectangular in shape. In FIG. 6, a width 612 of the EL lighting surface 610 is approximately 72 inches. In FIG. 6, a height 614 of the EL lighting surface 610 is approximately 8.5 inches. A pattern 616 is included on the safety sign 600 similar to embodiments described above. In one embodiment the pattern includes a text message that states "Stay Back—Stay Alive." In one embodiment the pattern includes a text message that states "Oversized Load." Any number of safety messages are possible within the scope of the invention. In addition to text, as described above, shapes or symbols are also possible to convey a message of safety. For example, a triangle may be used to indicate a slow moving vehicle.

Figure 7:
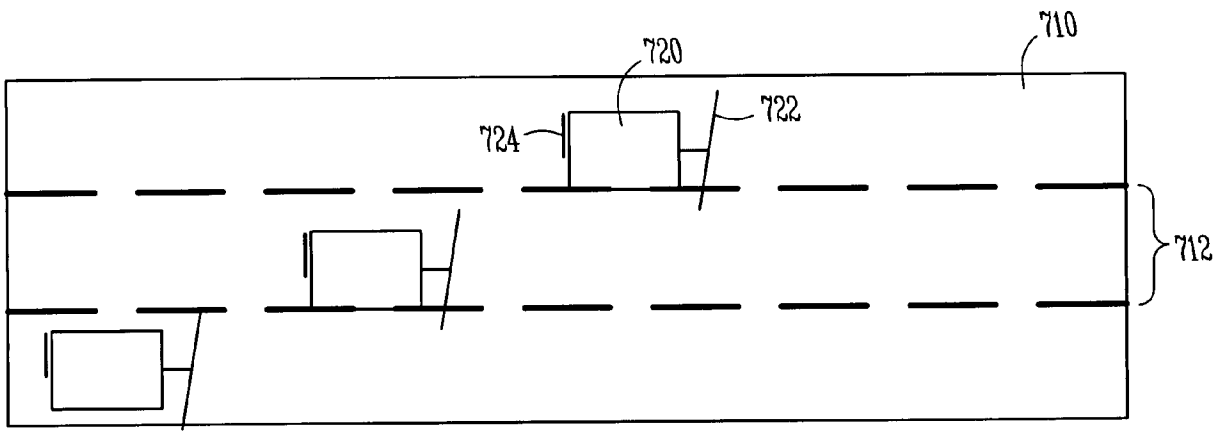
FIG. 7 shows a diagram of one embodiment of a method for plowing a road.

FIG. 7 shows an embodiment of a method utilizing safety signs as described in embodiments above. A road 710 is shown with a number of lanes 712. A number of vehicles 720 are shown on the road in a formation. In one embodiment, the vehicles 720 include snowplows. Other embodiments of vehicles include, but are not limited to, road graders, dump trucks, various construction equipment, road transportation vehicles, flat bed trucks, etc. The vehicles 720 as shown in FIG. 7 are snownplows, each vehicle 720 including a plow 722. In one embodiment, a safety sign 724 as described in embodiments above is affixed to at least one vehicle 720. In one embodiment, the vehicles 720 guide off each other in alignment using the safety signs 724. In one embodiment, the safety signs 724 are affixed to the rear of the vehicles 720. In one embodiment, the safety signs 724 are affixed to the front of the vehicles 720. One of ordinary skill in the art, having the benefit of the present specification will appreciate that several possible formations of vehicles are possible within the scope of the invention.

Figure 8:
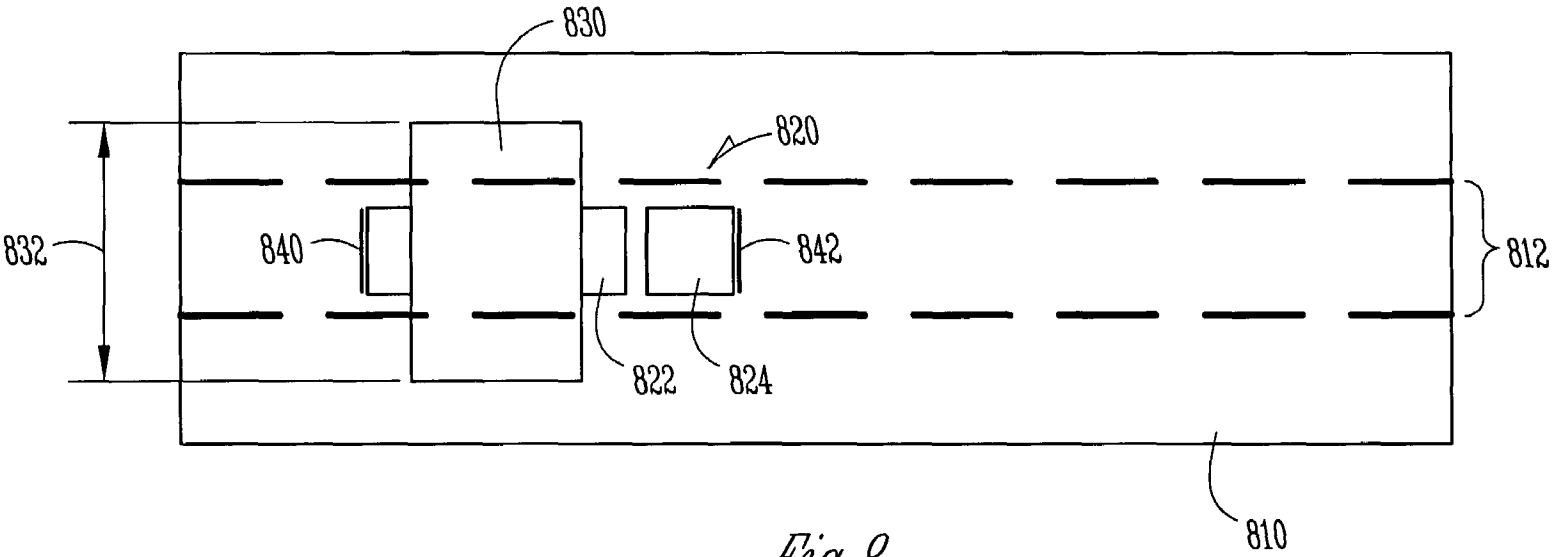
FIG. 8 shows a diagram of one embodiment of a method for transporting an oversized load.

FIG. 8 shows an embodiment of a method utilizing safety signs as described in embodiments above. A road 810 is shown with a number of lanes 812. A transportation vehicle 820 such as a flat bed truck is shown with a payload portion 822 and a cab portion 824. A load 830 is shown as an oversized load with a width 832 that affects more than one lane 812. A safety sign 840 according to embodiments described above is shown attached to a rear portion of the transportation vehicle 820. In one embodiment, an additional safety sign 842 according to embodiments described above is shown attached to a front portion of the transportation vehicle 820.

For some embodiments, vehicles include more than one safety sign using EL lighting. The signs are positionable on the front and rear and side portions of a vehicle. In one embodiment, safety signs and other indicia illuminated by EL lighting are positionable on mud flaps. Mud flaps, as used herein, are a component of a vehicle.

Figure 9:
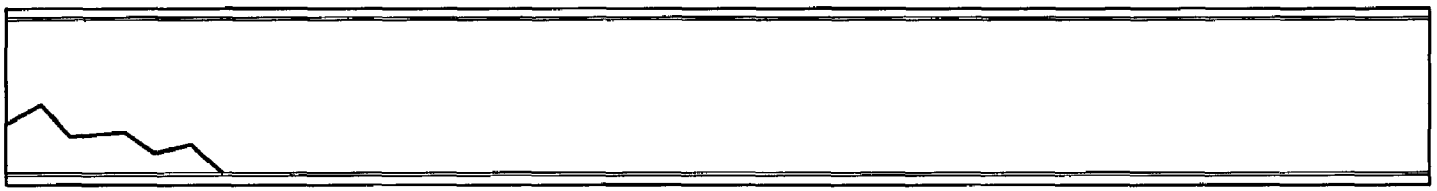
FIG. 9 shows a print for an embodiment of a safety sign according to an embodiment of the invention.

FIG. 9 shows a print of a safety sign according to one embodiment of the invention. FIG. 10 shows operational specifications according to one embodiment of the invention.

Safety signs as described above all utilize EL technology. EL technology provides a number of advantages to safety signs as described above. The safety signs described using EL technology use lower power than conventional lighting technology. The safety signs described using EL technology produce very low heat compared to conventional lighting technology. This can be especially advantageous in snow applications as discussed above in the background. The safety signs described using EL technology are more robust than conventional lighting technology, and not prone to catastrophic failure. Due to numerous encapsulated phosphor portions, it is difficult to damage all encapsulated phosphor portions during an event such as a rock hitting a sign. Further, EL lighting does not burn out catastrophically as incandescent light bulbs do.

Further, because EL lighting generates light from encapsulated portions along a large area (such as 72 inches by 8.5 inches) the light provided by the EL lighting is not a point source, but is an area source. This reduces or eliminates night blinding, and flicker produced by point sources such as incandescent lights, and LEDs. Further, the area source of EL lighting can be seen from farther away, and through difficult conditions such as snow, dust, fog, etc. This is due to EL lighting providing numerous sources (an area of sources) of light to compensate for scattering and dispersement of light from any one individual source in the EL surface.

For the reasons above, safety signs as described above are more visible in poor conditions such as snow, dust, fog, low light, etc. Safety signs as described above can be seen from farther away than conventional signs. Safety signs as described above eliminate problems associated with point source lighting.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A method, comprising:

forming a safety sign, including forming an EL lighting surface into a chosen pattern;

attaching the safety sign to one or more vehicles, wherein the safety sign is attached to a rear end of the vehicle so that at least one portion of the safety sign is proximate the driver's side of the vehicle to allow a driver behind the vehicle to be able to locate the rear and driver's side edge of the vehicle based on the visibility of the safety sign; and driving at least two of the vehicles in a formation on the road wherein the safety signs are visible to provide guidance for at least one driver of at least one of the vehicles; and further wherein the formation of the vehicles provides that at least two of the vehicles are at least partially laterally offset from one another with respect to a direction of travel.

2. A method, comprising:

forming a safety sign, including:

selecting a pattern to convey a visual safety message;

attaching the pattern to an EL lighting surface;

attaching the safety sign to one or more vehicles, wherein the safety sign is attached to a rear end of the vehicle so that at least one portion of the safety sign is proximate the driver's side of the vehicle to allow a driver behind the vehicle to be able to locate the rear and driver's side edge of the vehicle based on the visibility of the safety sign; and driving at least two of the vehicles in a formation on a road wherein the safety signs are visible to provide guidance for at least one driver of at least one of the vehicles; and further wherein the formation of the vehicles provides that at least two of the vehicles are at least partially laterally offset from one another with respect to a direction of travel.

3. The method of claim 2, wherein the vehicles include snow plows.

4. The method of claim 2, wherein selecting a pattern to convey a visual safety message includes selecting a text message.

5. The method of claim 2, wherein attaching the pattern to an EL lighting surface includes attaching the pattern to an EL lighting surface with a yellow color when the EL lighting surface is illuminated.

6. The method of claim 2, wherein attaching the pattern to an EL lighting surface includes attaching the pattern to a substantially flat EL lighting surface dimensioned to comply with safety sign regulations.

7. The method of claim 6, wherein attaching the pattern to an EL lighting surface includes attaching the pattern to a substantially flat EL lighting surface of approximate rectangular dimensions of 72 inches wide and 8.5 inches tall.

* * * * *

UNITED STATES PATENT AND TRADEMARK OFFICE

CERTIFICATE OF CORRECTION

PATENT NO. : 7,306,345 B2
APPLICATION NO. : 10/645873
DATED : December 11, 2007
INVENTOR(S) : Golle et al.

It is certified that error appears in the above-identified patent and that said Letters Patent is hereby corrected as shown below:

Title Page; item (56); on page 2, under "U.S. Patent Documents", in column 2, line 12, delete "Goelle" and insert -- Golle --, therefor.

In column 1, line 42, delete "bums" and insert -- burns --, therefor.

In column 5, line 15, delete "snownplows," and insert -- snowplows, --, therefor.

Signed and Sealed this

First Day of July, 2008

JON W. DUDAS
*Director of the United States Patent and Trademark Office*